US010610064B2

(12) United States Patent
Osborne et al.

(10) Patent No.: US 10,610,064 B2
(45) **Date of Patent: *Apr. 7, 2020**

(54) ELECTRONIC DISPENSER FOR FLEXIBLE ROLLED SHEET MATERIAL

(75) Inventors: Charles A. Osborne, Cumming, GA (US); Tsu-Ling Chang, Worthington, OH (US)

(73) Assignee: Valve Solutions, Inc., Alpharetta, GA (US)

( * ) Notice: Subject to any disclaimer, the term of this patent is extended or adjusted under 35 U.S.C. 154(b) by 1138 days.

This patent is subject to a terminal disclaimer.

(21) Appl. No.: 13/155,528

(22) Filed: Jun. 8, 2011

(65) Prior Publication Data

US 2012/0312853 A1 Dec. 13, 2012

(51) Int. Cl.
*A47K 10/36* (2006.01)
*B26F 3/02* (2006.01)
(Continued)

(52) U.S. Cl.
CPC ..... *A47K 10/36* (2013.01); *B26F 3/02* (2013.01); *B65H 20/005* (2013.01);
(Continued)

(58) Field of Classification Search
CPC ..... A47K 10/3625; A47K 2010/3668; A47K 10/36; A47K 10/3606; A47K 10/3612;
(Continued)

(56) References Cited

U.S. PATENT DOCUMENTS 3,730,409 A * 5/1973 Ratti ..... 225/14
6,314,850 B1 * 11/2001 Morand ..... 83/327
(Continued)

FOREIGN PATENT DOCUMENTS

EP 0 573 558 B1 12/1997
WO WO 1999/59457 11/1999

OTHER PUBLICATIONS

International Search Report dated Aug. 24, 2012 in International Application No. PCT/US2012/041377.
(Continued)

*Primary Examiner* — Clark F Dexter
(74) *Attorney, Agent, or Firm* — Womble Bond Dickinson (US) LLP

(57) ABSTRACT

An electronic dispenser for dispensing flexible sheet material. A control circuit receives a plurality of signals and controls dispensing of the sheet material. A tear bar is mounted within the housing for severance of sheet material by the user. A pivotally mounted pawl member is located proximate to the tear bar such that movement of sheet material into the tear bar for severance pivots the pawl member from a first position to a second position. Movement of the pawl member to the second position causes a signal to be sent to notify the control circuit that the sheet material has been removed. The dispensing mechanism is operative in a first mode to be responsive to a signal from a proximity sensor to dispense a sheet of material, and is operative in a second mode to dispense a next sheet in response to the signal generated by movement of the pawl member to the second position in response to dispensed sheet material being removed from the dispenser.

33 Claims, 9 Drawing Sheets

(51) Int. Cl.
*B65H 16/02* (2006.01)
*B65H 20/00* (2006.01)
*A47K 10/38* (2006.01)

(52) U.S. Cl.
CPC ... *A47K 2010/3881* (2013.01); *Y10T 225/205* (2015.04); *Y10T 225/209* (2015.04)

(58) Field of Classification Search
CPC ..... A47K 10/3618; A47K 2010/3881; B65H 20/005; B26F 3/02; Y10T 83/896; Y10T 225/205; Y10T 225/209
USPC ..... 83/649; 225/10, 14; 242/554.2, 563, 242/563.1, 563.2, 564.1, 564.4, 564.5, 242/590; 312/34.8
See application file for complete search history.

(56) References Cited

U.S. PATENT DOCUMENTS 6,412,679 B2 7/2002 Formon et al.
6,419,136 B2 7/2002 Formon et al.
6,695,246 B1 2/2004 Elliott et al.
6,710,606 B2 * 3/2004 Morris ..... 324/658
6,742,689 B2 6/2004 Formon et al.
6,830,210 B2 12/2004 Formon et al.
6,860,447 B2 3/2005 Boone et al.
6,871,815 B2 3/2005 Moody et al.
6,892,620 B2 5/2005 Kapiloff
7,017,856 B2 3/2006 Moody et al.
7,044,421 B1 5/2006 Omdoll et al.
7,114,677 B2 10/2006 Formon et al.
7,182,289 B2 2/2007 Moody et al.
7,213,782 B2 5/2007 Osborne et al.
7,237,744 B2 7/2007 Morris et al.
7,341,170 B2 3/2008 Boone
7,370,824 B1 5/2008 Osborne
7,387,274 B2 6/2008 Moody et al.
7,624,664 B2 12/2009 Morris et al.
7,698,980 B2 4/2010 Morris et al.
7,793,882 B2 * 9/2010 Reinsel et al. ..... 242/563
7,845,593 B2 12/2010 Formon et al.
8,382,026 B2 * 2/2013 Keily et al. ..... 242/564.1
9,144,352 B2 * 9/2015 Cittadino et al. ..... A47K 10/36
2003/0116003 A1 * 6/2003 Kapiloff ..... A47K 10/36 83/649
2003/0222779 A1 * 12/2003 Schotz et al. ..... A47K 10/36 340/562
2004/0178297 A1 * 9/2004 Moody et al. ..... A47K 10/3687 242/564.4
2005/0167541 A1 8/2005 Osborne
2005/0171634 A1 8/2005 York et al.
2006/0076913 A1 * 4/2006 Rodrian ..... A47K 10/36 318/272
2006/0169827 A1 8/2006 Lewis et al.
2007/0080255 A1 * 4/2007 Witt et al. ..... A47K 10/36 242/563.2
2007/0194166 A1 8/2007 Reinsel et al.
2008/0078777 A1 * 4/2008 Cittadino et al. ..... A47K 10/36 221/1
2008/0087758 A1 4/2008 Formon et al.
2008/0099595 A1 5/2008 Lewis et al.
2008/0100185 A1 * 5/2008 Lewis ..... A47K 10/36 312/34.22
2008/0100982 A1 5/2008 Lewis et al.
2008/0128446 A1 6/2008 Kuehneman et al.
2008/0128448 A1 6/2008 Cittadino et al.
2009/0198373 A1 * 8/2009 Mok et al. ..... A47K 10/36 700/231
2010/0078459 A1 4/2010 Reinsel et al.
2010/0089939 A1 4/2010 Morris et al.
2010/0301157 A1 * 12/2010 Keily et al. ..... 242/564.1
2014/0091168 A1 * 4/2014 Keily et al. ..... 242/562
2016/0353945 A1 * 12/2016 Osborne, Jr. ..... A47K 10/3618
2016/0353946 A1 * 12/2016 Osborne, Jr. ..... A47K 10/3643
2016/0353947 A1 * 12/2016 Osborne, Jr. ..... A47K 10/3643

OTHER PUBLICATIONS

Written Opinon of the International Searching Authority dated Aug. 24, 2012 in International Application No. PCT/US2012/041377 filed Jun. 7, 2012.
Notice of Opposition to the European patent Application No. EP12800559.2-1601 / EP2716213 dated Aug. 8, 2017.

* cited by examiner

ELECTRONIC DISPENSER FOR FLEXIBLE ROLLED SHEET MATERIAL

TECHNICAL FIELD

Embodiments of the invention relate generally to paper product dispensers and, more particularly, to electronic dispensers for flexible sheet material.

BACKGROUND OF THE INVENTION

The dispensing of paper products has resulted in many different types of dispensing devices for controlling quantities dispensed as well as for determining how efficiently the paper products are dispensed. Primarily, these dispensers use mechanical paper feeding mechanisms, actuated by the user physically touching the dispenser equipment to deliver a fixed length of paper. This bodily contact can raise concerns over hygiene when such dispensers are located in public restroom facilities.

The use of electronic dispensers is becoming more prevalent especially in public restroom facilities where the electronic dispensers dispense a measured length of sheet material upon sensing the presence of a user. In such "hands free" operation, the user does not manually activate or otherwise contact the dispenser in order to initiate a dispense cycle.

Conventional electronic dispensers accumulate and discharge static electricity during the dispense cycle. Static charge can be generated by various components or operations such as the movement of sheet material over rollers, interactions between rollers, etc. If the static charge is not dissipated, the user may receive a static shock if he touches the dispenser during use. In addition, the static charge can adversely affect the electronic control and sensor circuitry in the dispenser.

SUMMARY

In one embodiment, an electronic dispenser is provided for dispensing flexible sheet material. The electronic dispenser can operate in a number of modes including a proximity detection mode in which a proximity sensor detects the presence of a user's hand when placed into proximity with the dispenser, and a butler mode in which the dispenser automatically dispenses another measured sheet of sheet material. In butler mode, the electronic dispenser does not use a hand detection proximity sensor. Embodiments of the invention disclosed herein are operative in multiple modes. A dispenser housing contains a support mechanism for holding at least one roll of sheet material, and includes a base for mounting to a surface, a cover pivotally mounted to the base, and a discharge chute formed within the housing for discharging the sheet material from the dispenser. A control circuit in the housing controls dispensing of the sheet material from the housing. A dispensing mechanism drives sheet material from the housing upon receiving a signal from the control circuit. The dispenser includes an adjustable proximity sensor. A tear bar is mounted within the housing for severance of sheet material by the user. A pivotally mounted pawl member is located proximate to the tear bar such that movement of sheet material into the tear bar for severance pivots the pawl member from a first position to a second position. A signal means cooperative with the pawl member is located such that movement of the pawl member to the second position causes the signal means to send a signal to notify the control circuit that the sheet material may have been removed. The dispensing mechanism is operative in a first mode to be responsive to a signal from the proximity sensor to dispense a sheet of material, and is operative in a second mode to dispense a next sheet in response to the signal means being activated by movement of the pawl member to the second position.

In another embodiment, an electronic dispenser is provided for dispensing flexible sheet material. A dispenser housing contains a support mechanism for holding at least one roll of sheet material, and includes a base for mounting to a surface, a cover pivotally mounted to the base, and a discharge chute formed within the housing for discharging the sheet material from the dispenser. A control circuit in the housing controls dispensing of the sheet material from the housing. A dispensing mechanism drives sheet material from the housing upon receiving a signal from the control circuit. The dispenser includes an adjustable proximity sensor. A tear bar is mounted within the housing for severance of sheet material by the user. A pivotally mounted pawl member is located proximate to the tear bar such that movement of sheet material into the tear bar for severance pivots the pawl member from a first position to a second position. A signal means cooperative with the pawl member is located such that movement of the pawl member to the second position causes the signal means to send a signal to notify the control circuit that the sheet material may have been removed from the discharge chute. A paper detection sensor is activated by the control circuit to verify that the sheet material has been removed from the discharge chute. The dispensing mechanism is operative in a first mode to be responsive to a signal from the proximity sensor to dispense a sheet of material, and is operative in a second mode to dispense a next sheet in response to a signal from the paper detection sensor that the sheet material has been removed from the dispenser.

In a further embodiment, an electronic dispenser is provided for dispensing flexible sheet material. A dispenser housing contains a support mechanism for holding at least one roll of sheet material, and includes a base for mounting to a surface, a cover pivotally mounted to the base, and a discharge chute formed within the housing for discharging the sheet material from the dispenser. A control circuit in the housing controls dispensing of the sheet material from the housing. A dispensing mechanism drives sheet material from the housing upon receiving a signal from the control circuit. The dispenser includes a proximity sensor having an adjustable detection range. A tear bar is mounted within the housing for severance of sheet material by the user, wherein movement of sheet material into the tear bar for severance moves the tear bar from a first position to a second position. The tear bar can be pivotally mounted or slideably mounted within the housing. A signal means cooperative with the tear bar is located such that movement of the tear bar to the second position causes the signal means to send a signal to notify the control circuit that the sheet material may have been removed from the discharge chute. A paper detection sensor is activated by the control circuit to verify that the sheet material has been removed from the discharge chute. The dispensing mechanism is operative in a first mode to be responsive to a signal from the proximity sensor to dispense a sheet of material, and is operative in a second mode to dispense a next sheet in response to a signal from the paper detection sensor that the sheet material has been removed from the dispenser.

BRIEF DESCRIPTION OF THE DRAWINGS

These and other advantages and aspects of the embodiments of the disclosure will become apparent and more readily appreciated from the following detailed description of the embodiments taken in conjunction with the accompanying drawings, as follows.

DETAILED DESCRIPTION

The following description is provided as an enabling teaching of embodiments of the invention including the best, currently known embodiment. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances. Thus, the following description is provided as illustrative of the principles of the embodiments of the invention and not in limitation thereof, since the scope of the invention is defined by the claims.

The embodiments described utilize concepts disclosed in commonly-owned U.S. Pat. No. 7,213,782 entitled "Intelligent Dispensing System" and U.S. Pat. No. 7,370,824 entitled "Intelligent Electronic Paper Dispenser," both of which are incorporated by reference in their entireties herein. The embodiments also utilize concepts disclosed in published patent application US 2008/0100982 entitled "System and Method for Dissipating Static Electricity in an Electronic Sheet Material Dispenser" and incorporated by reference in its entirety herein.

Embodiments of the electronic dispenser include a drive motor and gear assembly mounted within the dispenser housing. The motor includes a drive shaft and a drive gear attached thereto that engages the shaft of the drive roller. The gear assembly transmits motive force from the motor to the drive roller. Thus, upon energizing the motor, the drive roller is caused to rotate, which results in conveyance of the sheet material disposed in the nip between the pressure roller and drive roller along the conveying path and out of the dispensing throat of the housing. A tear bar is disposed in the throat so that a user can separate a sheet of the material by grasping and pulling the sheet across the tear bar. In an alternative embodiment, an automatic cutting device may be provided to automatically cut the sheet of material.

It should be appreciated that the electronic dispenser is not limited to any particular style, configuration, or intended type of sheet material. For example, the dispenser may be a towel dispenser, toilet tissue dispenser, or any other sheet material dispenser.

Figure 8:
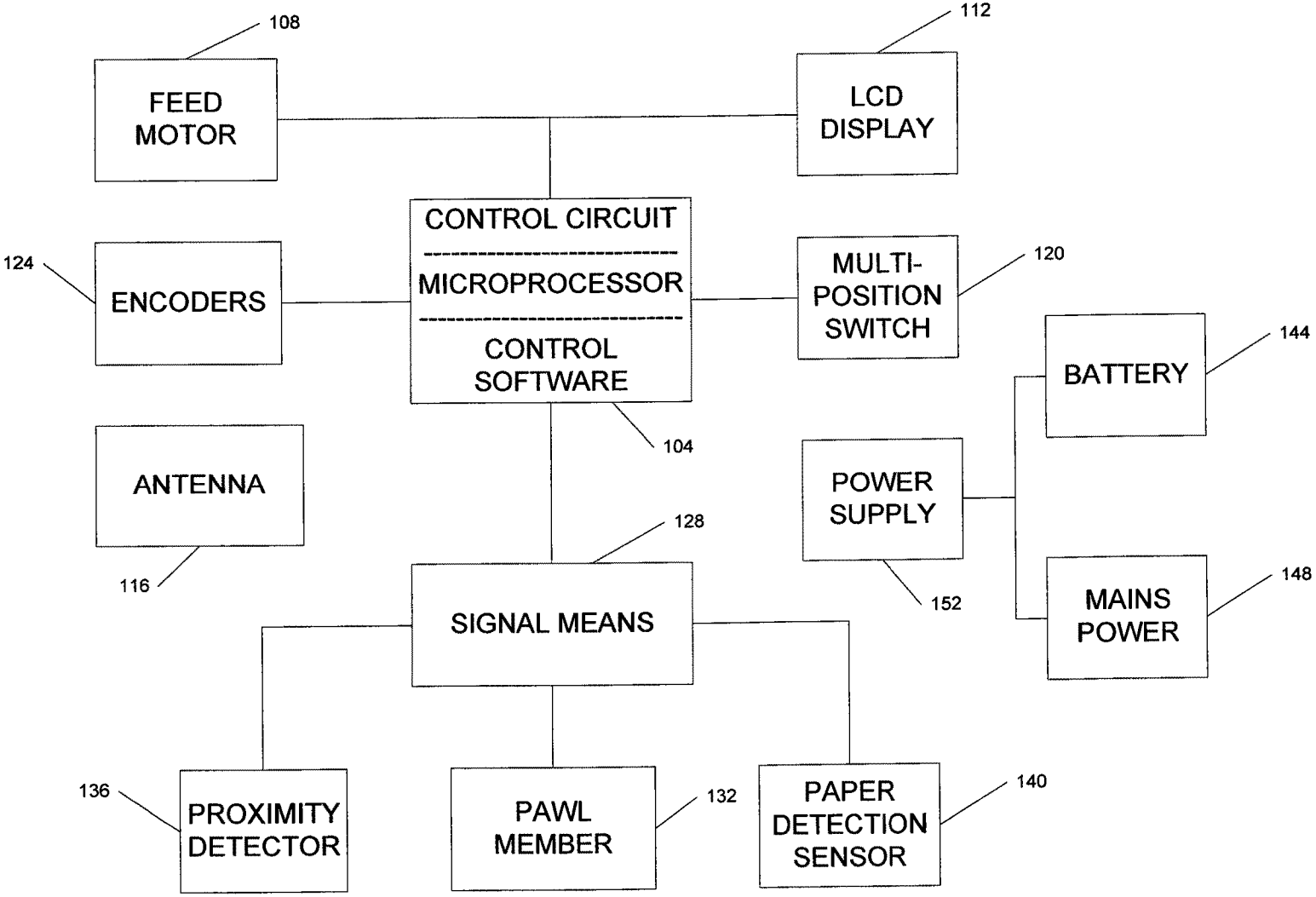
FIG. 8 illustrates a block diagram of the electronic control system contained within the dispenser in an exemplary embodiment.

FIG. 8 illustrates a block diagram of the electronic control system contained within the dispenser in an exemplary embodiment. The dispensing mechanism may be powered by batteries 144 contained in a battery compartment. Any suitable battery storage device may be used for this purpose. A conductor may be disposed below the battery compartment that mates with contacts on the underside of the battery compartment for delivering power 152 from the batteries 144 to the circuitry in the housing and the drive motor 108. Alternatively, or in addition to battery power, the dispenser may also be powered by a building's alternating current (AC) distribution system 148. For this purpose, a plug-in modular transformer/adapter could be provided with the dispenser, which connects to a terminal or power jack port located, for example, in the bottom edge of the circuit housing for delivering power to the control circuitry and associated components. The control circuitry 104 may include a mechanical or electrical switch that isolates the battery circuit upon connecting the AC adapter in order to protect and preserve the batteries.

In an electronic dispenser, a sensor 136 may be provided to detect an object placed in a detection zone external to the dispenser. This sensor may be a passive sensor that detects changes in ambient conditions, such as ambient light, capacitance changes caused by an object in a detection zone, and so forth. In an alternate embodiment, the sensor may be an active device and include an active transmitter and associated receiver, such as one or more infrared (IR) transmitters and an IR receiver. The transmitter transmits an active signal in a transmission cone corresponding to the detection zone, and the receiver detects a threshold amount of the active signal reflected from an object placed into the detection zone. Control circuitry 104 is configured with the sensor 136 for initiating a dispense cycle upon a valid detection signal from the receiver.

The dispenser control circuitry 104 controls activation of the dispensing mechanism upon valid detection of a user's hand for dispensing a measured length of the sheet material. Sensors and associated circuitry may be provided for this purpose. Various types of sensors are well known to those skilled in the art, including IR, radio frequency (RF), capacitive sensors, etc. Any one or a combination of such sensing systems can be used.

The control circuitry 104 also controls the length of sheet material dispensed. Any number of optical or mechanical devices may be used in this regard. In exemplary embodiments of the electronic dispenser, an optical encoder 124 may be used to count the revolutions of the drive roller, with this count being used by the control circuitry to meter the desired length of the sheet material to be dispensed. In other embodiments, the control circuitry 104 may track the running time of the motor 108 as the control variable, or detect perforations in the sheet material.

In an exemplary embodiment, the processing logic for operation of the electronic dispenser in the hand sensor and butler modes is part of the control software stored in the memory of the microprocessor in the control circuit 104. One or more binary flags are also stored in memory and represent an operational state of the dispenser (e.g., "paper cut" set or cleared). An operational mode switch in the dispenser sets the mode of operation. In the hand sensor mode, the proximity (hand) sensor 136 detects the presence of a user's hand below the dispenser and dispenses a measured amount of sheet material. The control circuit 104 will then monitor when the sheet of material is removed. Both the pawl member 132 and the paper detection sensor 140 can determine the removal of paper and reset the hand sensor 136. The hand sensor 136 will not allow additional paper to be dispensed until the hand sensor 136 is reset. If the hand sensor 136 detects the presence of a user's hand but does not dispense sheet material, the control circuit 104 can check for sheet material using the paper detection sensor 140. If sheet material has not been dispensed (i.e., no sheet material is hanging from the dispenser), the feed motor 108 will be activated to dispense a next sheet.

In the butler mode, the proximity sensor 136 for detecting the presence of a user's hand is deactivated. The control circuit 104 will then automatically dispense sheet material when the cover is closed and the dispenser is put into operation. The paper detection sensor 140 will determine if a sheet is hanging from the dispenser. If sheet material is hanging, the control circuit 104 will then monitor when the sheet of material is removed. Both the pawl member 132 and the paper detection sensor 140 can determine the removal of paper and reset the dispenser. The next sheet will be dispensed automatically. If the paper detection sensor 140 determines the absence of hanging sheet material, the feed motor 108 will be activated to dispense the next sheet. The control circuit 104 will then determine if the sheet has been removed before dispensing another sheet.

Figure 9:
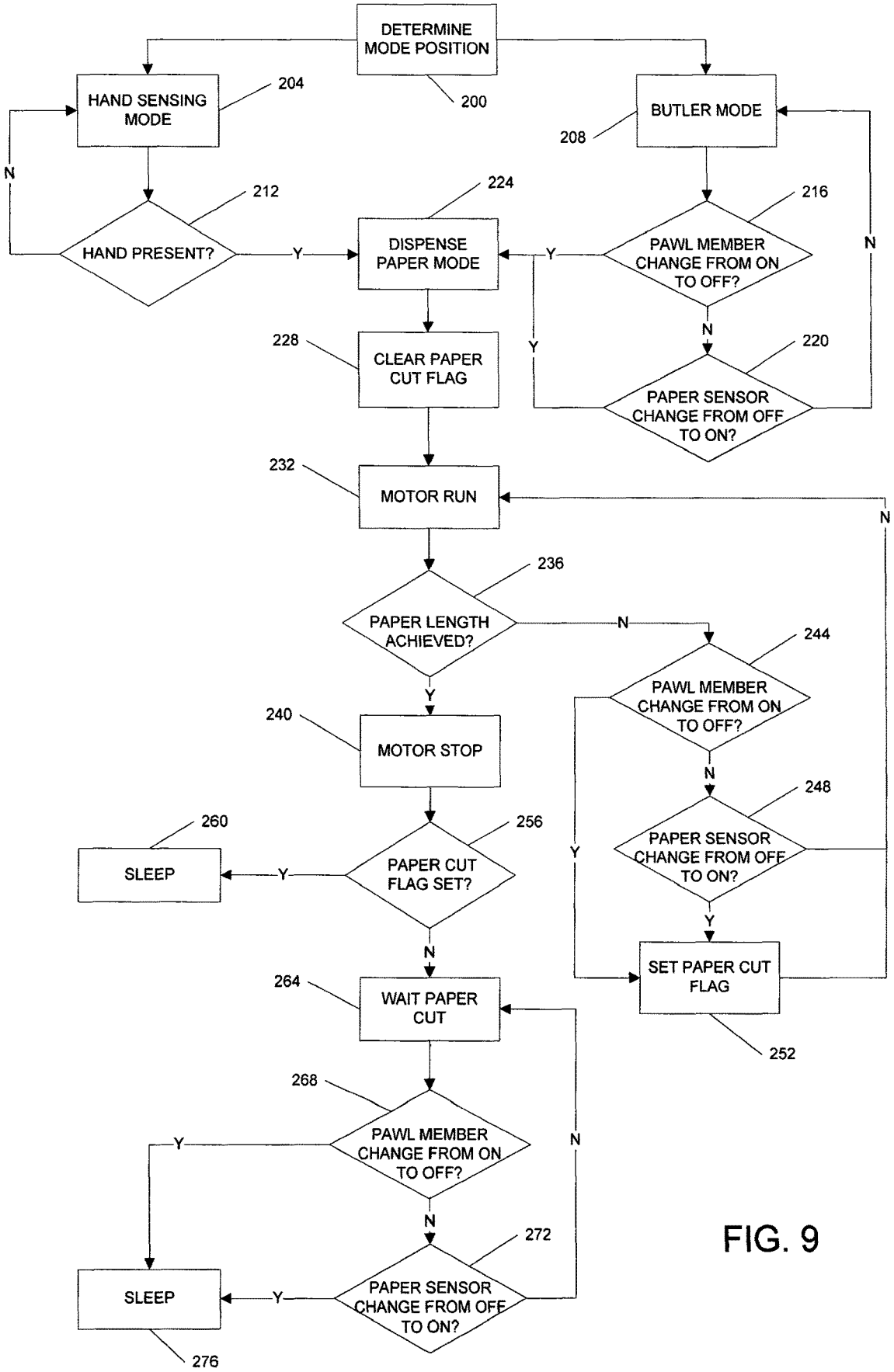
FIG. 9 illustrates the processing logic for operation of the electronic dispenser in a plurality of modes of operation in an exemplary embodiment.

FIG. 9 illustrates the processing logic of the control software for operation of the electronic dispenser in the hand sensor and butler modes in an exemplary embodiment. The processing logic first determines the position of an operational mode switch in logic block 200. If the electronic dispenser is in the hand sensing mode in logic block 204, the processing logic will determine if a hand is present in proximity to the hand sensor in decision block 212. Until the presence of a hand is detected, the dispenser will remain in hand sensing mode as indicated in logic block 204. If a hand is detected by the proximity sensor, the dispenser begins a dispense paper mode as indicated in logic block 224. A "paper cut" flag is then cleared in the control memory that stores the control software and flags for operation of the dispenser as indicated in logic block 228. The feed motor then runs as indicated in logic block 232 to dispense a predetermined length of sheet material.

If the predetermined paper length has been achieved in decision block 236, the feed motor stops running as indicated in logic block 240. In decision block 256, the state of the paper cut flag in control circuit memory is tested. In normal operation, the paper cut flag is set when the user tears the hanging paper from the dispenser. If the paper cut flag is set, the control circuit enters a sleep mode until the next user is detected. This step is indicated in logic block 260. If the paper cut flag is not set in decision block 256, the control software waits for a paper cut (i.e., user tears hanging paper) as indicated in logic block 264. In decision block 268, the processing logic checks whether or not the pawl member position has changed from on to off. In other words, this test determines if the pawl member has reset after the paper tear. If the pawl member has changed from the on to off position, the control circuit enters a sleep mode in logic block 276 until the next user is detected. If the pawl member has not changed from on to off, a test is performed by the control software to determine the status of the paper detection in decision block 272. If the paper detection sensor has changed from off to on, the control circuit enters a sleep mode as indicated in logic block 276. If the paper detection sensor is determined to be off, processing logic returns to logic block 264 to wait for a paper cut.

If the predetermined paper length has not been achieved in decision block 236, a test is made in decision block 244 to determine if the pawl member has changed from the on to off position. If the pawl member has changed to the on position, then the paper cut flag stored in control memory is set as indicated in logic block 252. This is followed in logic block 232 with the feed motor again running to dispense a predetermined length of sheet material. If it is determined in decision block 244 that the pawl member has not changed to the off position, a test is made in decision block 248 to determine if the paper detection sensor is on. If the paper detection sensor is on, the paper cut flag in control memory is set as indicated in block 252. The processing logic returns to logic block 232 to run the feed motor. If the paper detection sensor is determined to be off in decision block 248, the feed motor again runs (logic block 232) to dispense a predetermined length of sheet material.

If the electronic dispenser is in the butler mode of operation as indicated in logic block 208, the processing logic will determine if the pawl member has changed from the on to off position in decision block 216. If the pawl member has changed from the on to the off position, the dispenser will enter the dispense paper mode as indicated in logic block 224. If the pawl member has not changed from the on to the off position in decision block 216, a test is made in decision block 220 to determine the status of the paper detection sensor. If the paper detection sensor is found to be off, the dispenser remains in the butler mode as indicated in logic block 208. If the paper detection sensor is found to be on, the dispenser enters the dispense paper mode as indicated in logic block 224. Beginning with the dispense paper mode step of logic block 224, the processing logic (blocks 224-276) is the same for both hand sensing and butler modes.

Figure 1:
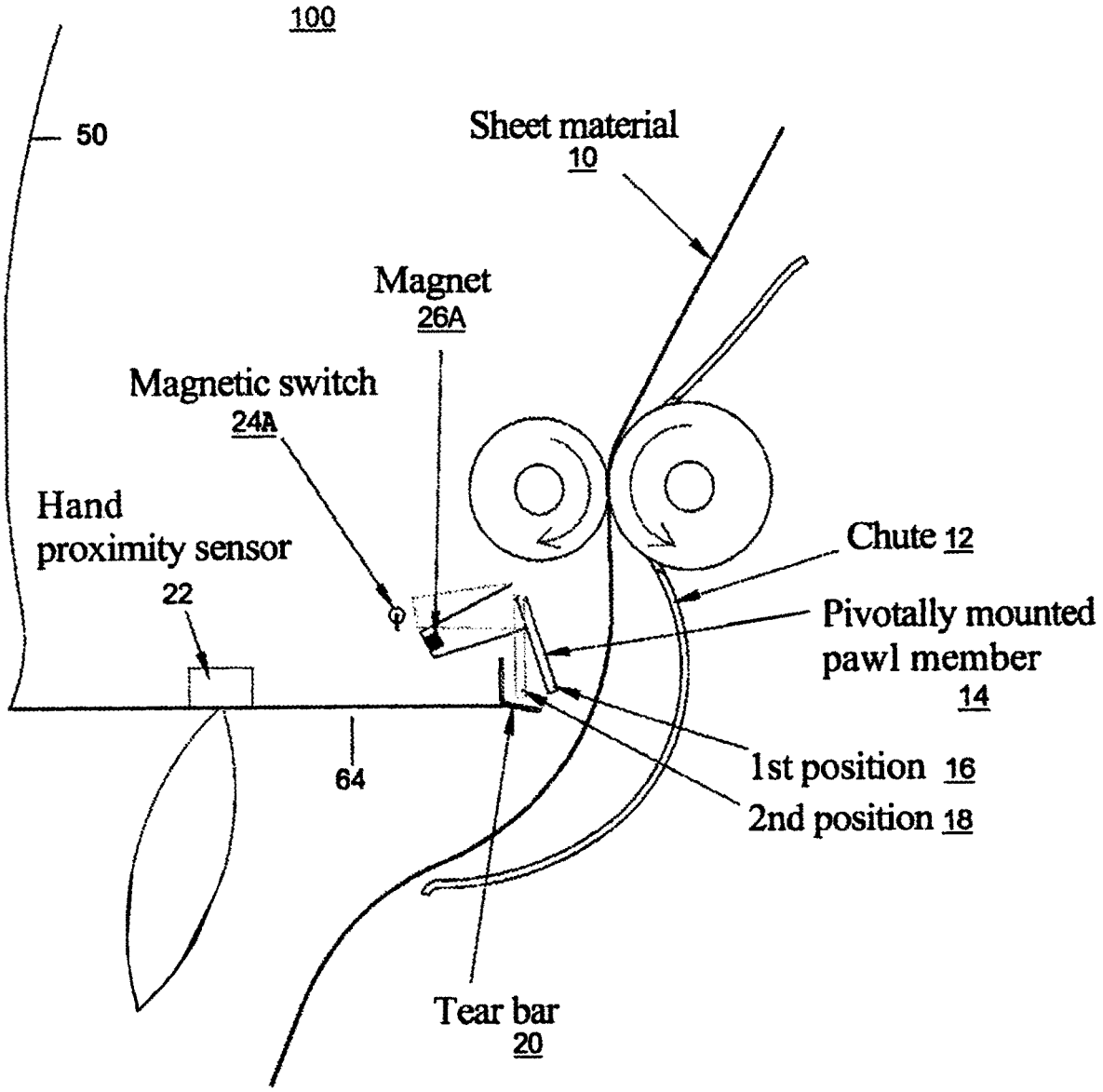
FIG. 1 illustrates a partial side view of a dispensing mechanism for dispensing flexible rolled sheet material having a moveable pawl member in an exemplary embodiment.

FIG. 1 illustrates a partial side view of a dispensing mechanism 100 for dispensing flexible rolled sheet material 10 having a moveable pawl member 14 in an exemplary embodiment. The electronic dispenser housing contains a support mechanism for holding at least one roll of sheet material. The roll of sheet material rides on a drive roller. With reference to FIGS. 1, 3A-3B, and 8, in one embodiment, the housing can include a base panel 52 for mounting to an external surface, a cover panel 50 pivotally mounted to the base panel, and a discharge chute 12 formed within the housing for discharging the sheet material 10 from the dispenser 100. The support mechanism for the roll product could be pivotally mounted within the housing as discussed below. A control circuit 104 receives a plurality of signals from sensors 136, 140 and signal means 128 and controls dispensing of the sheet material 10 from the housing. The dispensing mechanism 100 is coupled to a motor 108 to drive sheet material 10 from the housing upon receiving a signal from the control circuit 104. The dispenser includes an adjustable proximity sensor 22 to detect the presence of a user's hand and dispense measured amounts of sheet material 10. In the embodiment of the dispenser illustrated in FIGS. 1-2B, a photoelectric, infrared (IR) sensing system may be used to detect the presence of a user's hands placed below the bottom portion of the dispenser housing. A tear bar 20 (FIG. 2A) is rigidly mounted within the housing for severance of sheet material 10 by the user. A pivotally mounted pawl member 14 is located proximate to the stationary tear bar 20 such that movement of sheet material 10 into the tear bar 20 for severance pivots the pawl member 14 from a first position 16 to a second position 18.

In one embodiment, a signal means 128 cooperative with the pawl member 14 is located such that movement of the pawl member 14 to the second position 18 causes the signal means to send a signal to notify the control circuit 104 that the sheet material 10 has been removed. The signal means 128 that are cooperative with the pawl member 14 can include a magnetic switch 24A and magnet 26A or a mechanical switch. In another embodiment illustrated in FIG. 4, after receiving a signal that sheet material 10 may have been removed, the control circuit 104 can activate a paper detection sensor 44, 46 to verify that the sheet material 10 has been removed from the discharge chute 12.

In one embodiment, the dispensing mechanism 100 is operative in a first mode to be responsive to a signal from the proximity sensor 22 to dispense a sheet of material. The dispensing mechanism is operative in a second mode to dispense a next sheet in response to the signal means being activated by movement of the pawl member 14 to the second position 18 in response to dispensed sheet material 10 being removed from the dispenser. In another embodiment, the dispensing mechanism 100 is operative in a second mode to dispense a next sheet in response to the signal means being activated by movement of the pawl member 14 to the second position 18, and a signal from the paper detection sensor 44, 46 (FIG. 4) that the sheet material 10 has been removed from the dispenser. In the embodiment shown in FIG. 4, an emitter 44 can be affixed to an external surface of the discharge chute 12 rather than inside the discharge chute 12.

The pawl member 14 is electrically conductive and electrically connected to the control circuit forming a first part of an electric circuit. Movement of the pawl member 14 to the second position 18 brings the pawl member 14 into contact with one or more electrically conductive contact members. The conductive contact member is electrically connected to the control circuit 104 forming a second part of an electric circuit such that movement of the pawl member 14 into contact with the electrically conductive contact member completes the electric circuit and sends a signal to the control circuit 104.

Figure 2A:
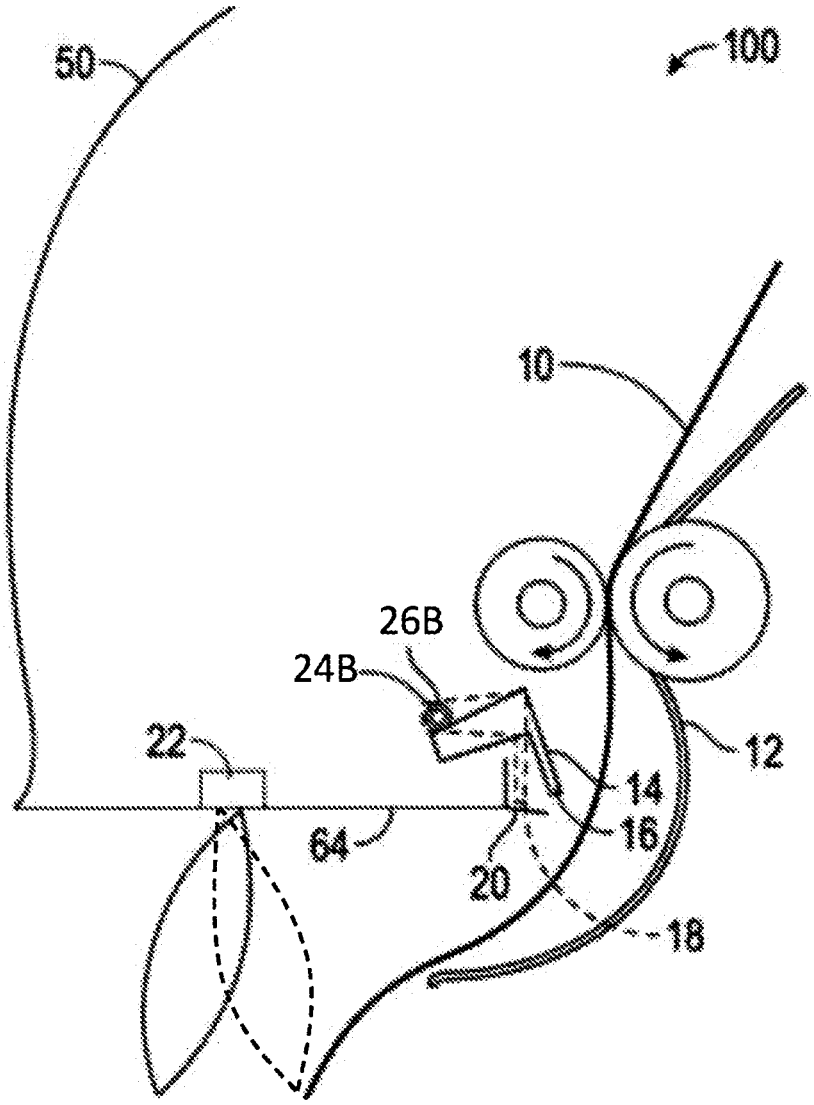
FIG. 2A illustrates a side views of a dispensing mechanism for dispensing flexible rolled sheet material having a moveable pawl member.
Figure 2B:
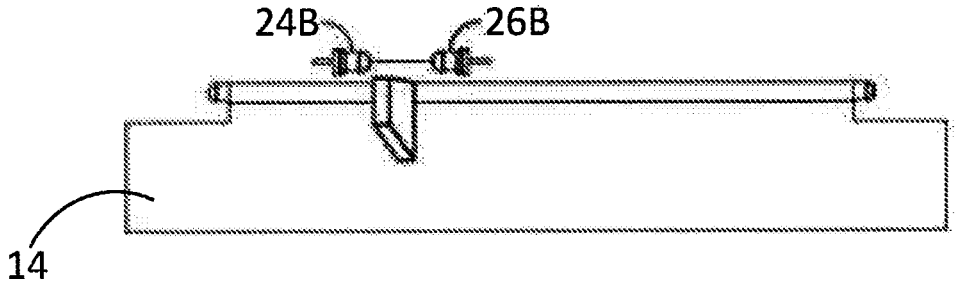
FIG. 2B illustrates a front view of the pawl member and detector of the dispenser of FIG. 2A.

In one embodiment, as indicated in FIGS. 2A and 2B, the signal means 128 cooperative with the pawl member 14 includes an infrared emitter 24B and detector 26B positioned opposite one another such that pivoting of the pawl member 14 to the second position 18 blocks reception of emitted light by the detector thereby sending a signal to the control circuit 104. In another embodiment, the signal means 128 cooperative with the pawl member 14 includes an infrared emitter/detector pair mounted in the housing such that moving the pawl member to the second position reflects emitted light back to the detector thereby sending a signal to the control circuit 104.

In a further embodiment not including a pawl member, an electronic dispenser 100 for dispensing flexible rolled sheet material 10 in an exemplary embodiment can have a moveable tear bar. Similar to the pawl member embodiments, the dispenser 100 housing contains a support mechanism for holding at least one roll of sheet material. The roll of sheet material 10 rides on a drive roller. The housing includes a base panel 52 for mounting to an external surface, a cover panel 50 pivotally mounted to the base panel, and a discharge chute 12 formed within the housing for discharging the sheet material 10 from the dispenser 100. The support mechanism for the roll of sheet material could be pivotally mounted within the housing. A control circuit 104 receives a plurality of signals and controls dispensing of the sheet material from the housing. The dispensing mechanism 100 is coupled to a motor 108 to drive sheet material 10 from the housing upon receiving a signal from the control circuit 104. The dispenser 100 includes an adjustable proximity sensor 22 for detecting the presence of a user's hand. A moveable tear bar is mounted within the housing for severance of sheet material 10 by the user, wherein movement of sheet material 10 into the tear bar for severance moves the tear bar from a first position to a second position. The tear bar can be pivotally or slideably mounted within the dispenser housing.

In one embodiment, a signal means 128 cooperative with the tear bar is located such that moving the tear bar to the second position causes the signal means 128 to send a signal to notify the control circuit 104 that the sheet material may have been removed. The signal means 128 that are cooperative with the tear bar can include either a magnetic switch or a mechanical switch. In another embodiment, after receiving a signal that sheet material may have been removed, the control circuit 104 can activate a paper detection sensor to verify that the sheet material has been removed from the discharge chute.

In one embodiment, the dispensing mechanism 100 is operative in a first mode to be responsive to a signal from the proximity sensor to dispense a sheet of material. In another embodiment, the dispensing mechanism 100 is operative in a second mode to dispense a next sheet in response to the signal means 128 being activated by the tear bar moving to the second position, and a signal from the paper detection sensor that the sheet material has been removed from the dispenser.

In one embodiment, the signal means 128 cooperative with the tear bar includes an infrared emitter and detector positioned opposite one another such that movement of the tear bar to the second position blocks reception of emitted light by the detector thereby sending a signal to the control circuit 104. In another embodiment, the signal means 128 cooperative with the tear bar includes an infrared emitter/detector pair 24, 26 mounted in the housing such that movement of the tear bar to the second position reflects emitted light back to the detector thereby sending a signal to the control circuit 104.

For some embodiments as shown in FIG. 8, a multi-position switch 120 in operable communication with the control circuit 104 is used to select one of a plurality of sheet lengths to be dispensed by the dispensing mechanism. An encoder 124 in operable communication with the control circuit 104 is used to control a measured length of delivered sheet material based on a setting of the multi-position switch 120.

In one embodiment, the multi-position switch 120 in operable communication with the control circuit 104 can be used to select a power output level delivered to the proximity sensor. The power output level is controlled by a resistive circuit comprising at least two resistors having different resistances. The multi-position switch 120 in operable communication with the control circuit 104 can be used to select one of a plurality of time periods as a delay between delivery of a first sheet and delivery of a next sheet to the user.

Figure 5:
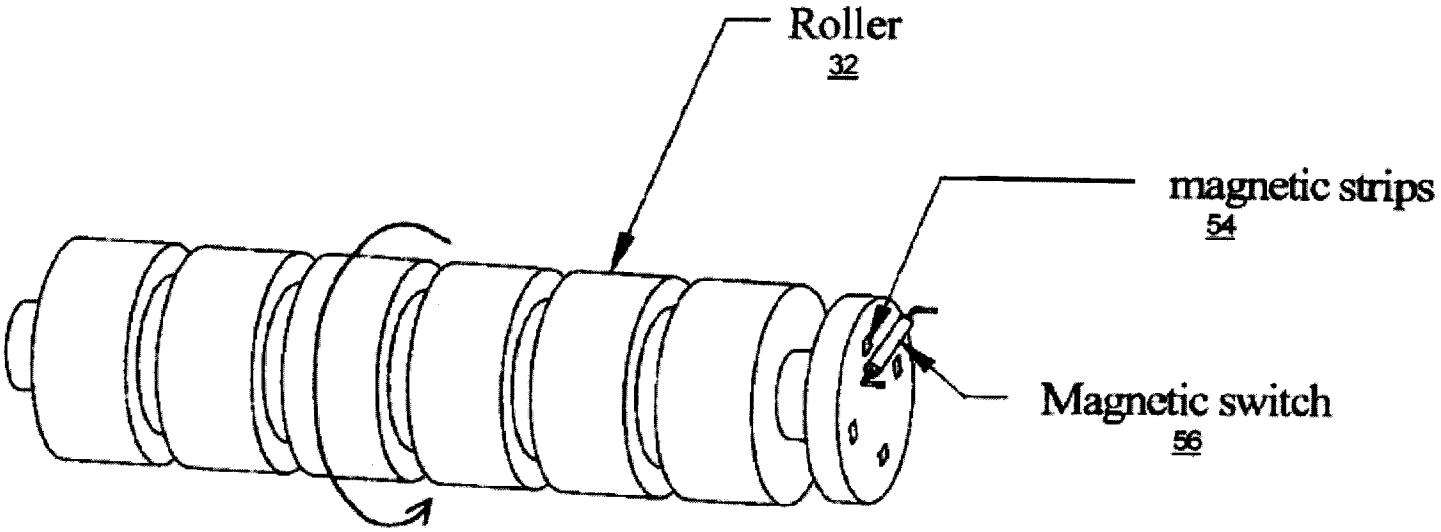
FIG. 5 illustrates an encoder mechanism for controlling the length of delivered sheet material in an exemplary embodiment.

With reference to FIG. 5, in one embodiment, an encoder could include a plurality of magnetic strips 54 integrally incorporated within or affixed around the periphery on one end of any roller 32 or any gear, and a magnetic switch 56 mounted in the housing in proximity to one end of any roller 32 or any gear such that magnetic strips 54 passing the magnetic switch 56 generate a series of pulses that the control circuit counts to determine when a selected amount of sheet material has been dispensed.

In another embodiment, an encoder could include a fan or star shaped reflective surface integrally incorporated within or affixed on one end of any roller or any gear and an infrared emitter/detector pair mounted in the housing in proximity to one end of any roller or any gear such that the leading and trailing edges of the reflective surface reflect emitted light back to the detector generating pulses countable by the control circuit to determine when a selected amount of sheet material has been dispensed.

Figure 6:
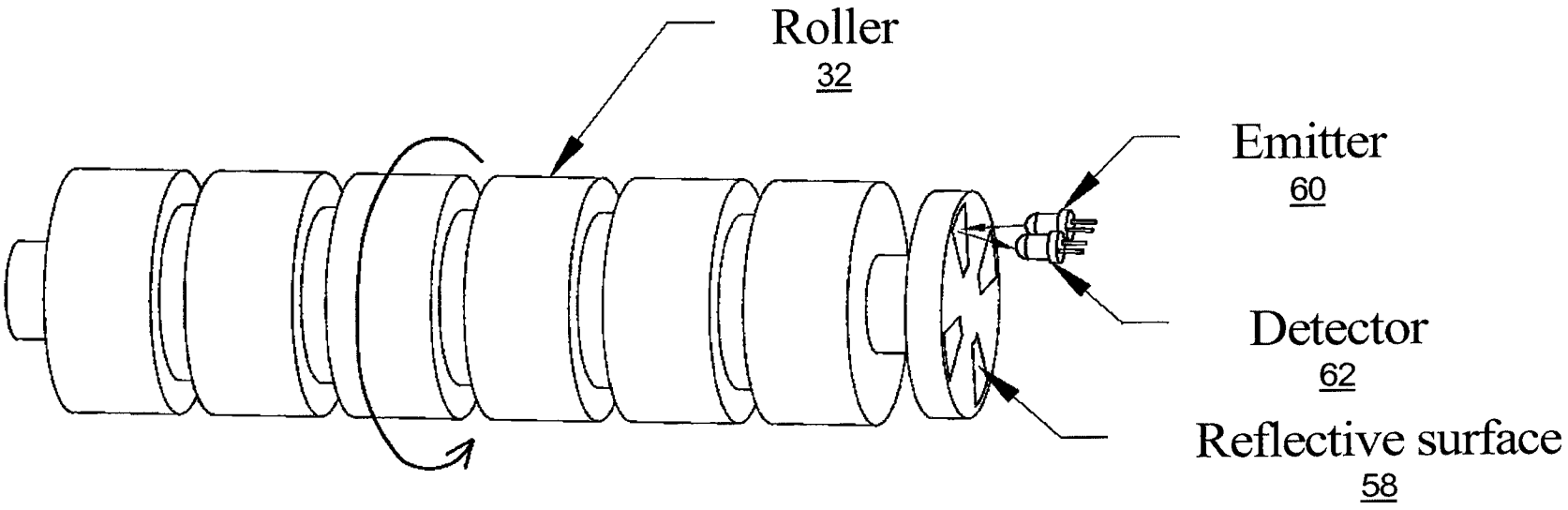
FIG. 6 illustrates an encoder mechanism for controlling the length of delivered sheet material in an exemplary embodiment.

With reference to FIG. 6, in another embodiment, an encoder could include a plurality of reflective strips 58 integral to or affixed around the periphery on one end of drive roller 32 and an infrared pair 60, 62 mounted in the housing in proximity to said one end of the drive roller 32 such that the reflective strips 58 passing the infrared emitter/detector pair 60, 62 receive light from the emitter 60 and reflect light back to the detector 62 generating a series of pulses that the control circuit counts to determine when a selected amount of sheet material 10 has been dispensed.

Figure 4:
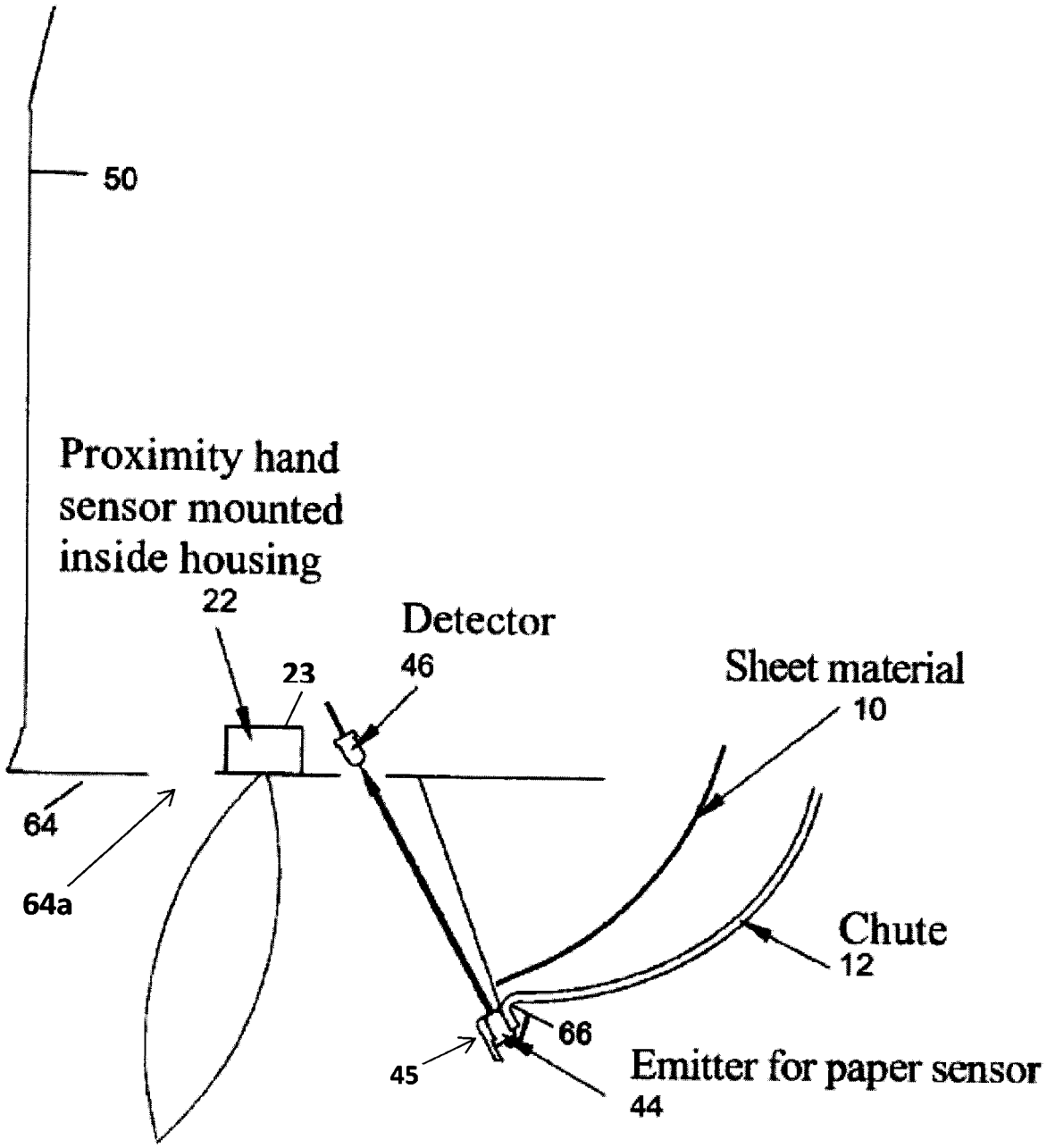
FIG. 4 illustrates a sensor mechanism for detecting the presence of sheet material in an exemplary embodiment.

As shown in FIG. 4, in one embodiment, the hand proximity sensor 22 could be mounted in a housing 23 located adjacent an opening 64*a* a bottom panel 64 of the dispenser housing 100 forward of the discharge chute 12 facing downward and slightly rearward toward an outermost edge of the discharge chute 12. In this embodiment, the emitter 44 for the paper sensor could be mounted in a separate housing 45 affixed adjacent to an outer surface 66 of the discharge chute 12 facing toward the bottom surface 64 of the dispenser housing where detector 46 will detect a signal from the emitter 44 in the absence of paper hanging from the discharge chute 12.

In some embodiments, the proximity sensor can detect both a user's hand and a sheet hanging below a front edge of the discharge chute. For example, the proximity sensor 22 could include one infrared emitter and one infrared detector with the infrared emitter aligned to detect both the presence of a user's hand below the dispenser 100 and a sheet 10 hanging below an outermost front edge of the discharge chute 12. In other embodiments, the proximity sensor could include two infrared emitters and one infrared detector with one infrared emitter aligned to detect a user's hand below the dispenser 100 and the second infrared emitter aligned to detect a sheet hanging below the outermost front edge of the discharge chute 12.

Figure 7:
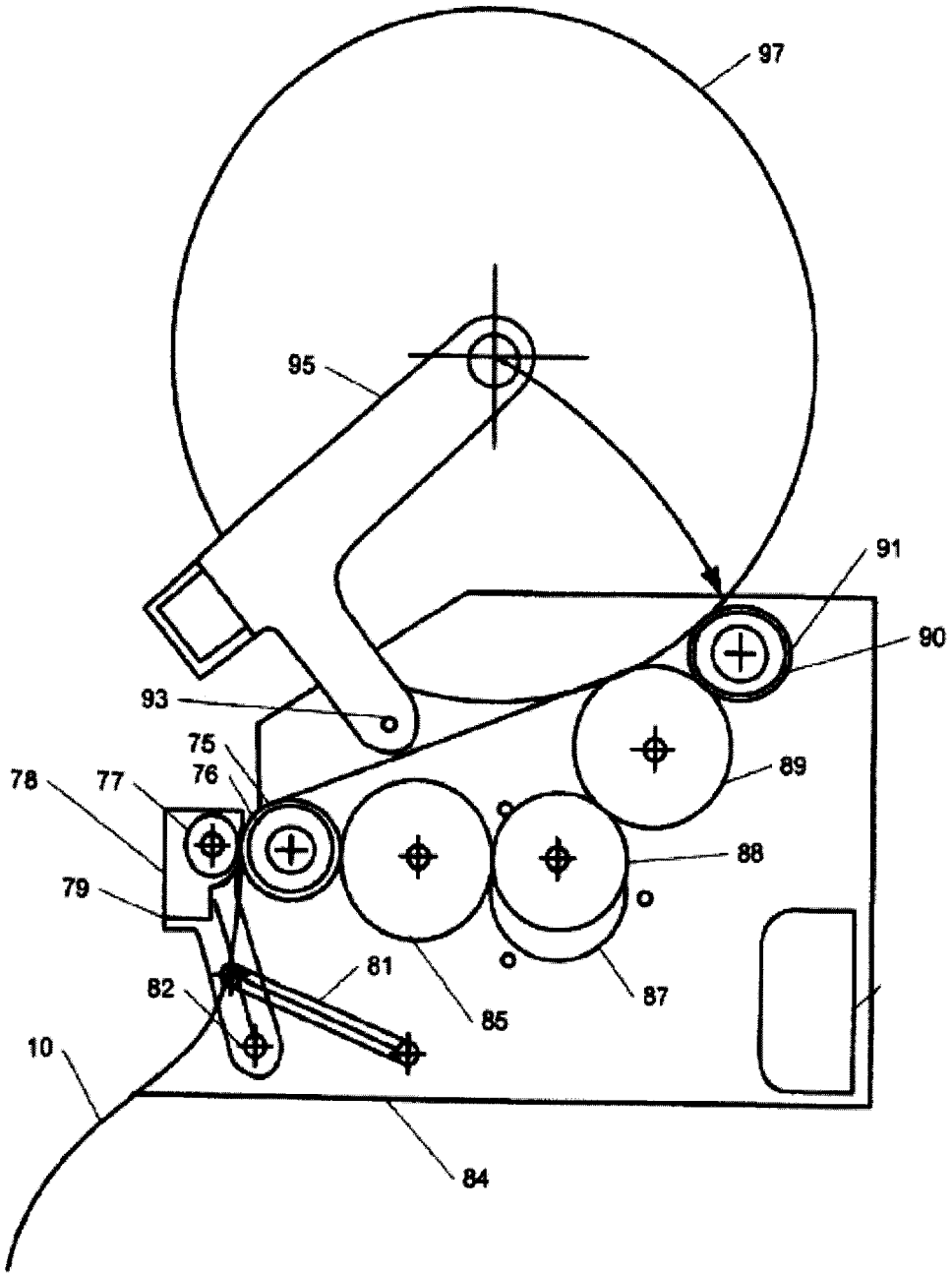
FIG. 7 illustrates a gravity-assisted roll feed mechanism in accordance with an exemplary embodiment of the present invention.

FIG. 7 illustrates a gravity-assisted roll feed mechanism in accordance with an exemplary embodiment that can be used in the pawl member embodiments and the moveable tear bar embodiment. The description that follows is incorporated from U.S. Pat. No. 7,213,782 and retains the reference numbers used therein for convenience. An electric motor 87 and the associated gears 76, 85, 88, 89, 90 turn the main product roller 91 and the exit rollers 75, 77 simultaneously for sheet material evacuation. The main product roller 91 rolls the sheet material from roll 97 while the exit rollers 75, 77 guide the sheet material from roll 97 through the front cover of the dispenser opening for presentation to the user. The gravity assisted roll and feed mechanism dispenses sheet material from roll 97 by allowing the sheet material 10 to be rolled automatically and fed to the user more efficiently. The sheet material dispensed 10 is roll fed by gear 76 between the pressing roller 77 and the exit roller 75. Tear bar 79 cuts the dispensed sheet material 10. The sheet material length dispensed is adjustable and can be metered by the main product roller 91.

With further reference to FIG. 7, the gravity-assisted roll feed mechanism uses an electric motor 87 in dispenser 84 to turn a gear assembly which activates the main product roller 91 and exit guide rollers 75, 77. The main product roller 91 and exit guide rollers 75, 77 operate at the same speed to ensure sheet material uniformity during evacuation eliminating product overspin which leads to lower incidence of product misfeeding and or jamming. The sheet material holder 95 and axis 93 maintain a consistent friction coefficient between the main product roller 91 and the roll of sheet material 97 (as the diameter/weight of the sheet material roll 97 changes) by changing the angle of the roll of sheet material 97 as applied to the main roller 91. The sheet material holder 95 is equipped with bearings (not shown) for more efficient rolling and less paper dust. The gravity assisted roll and feed mechanism utilizes gravity as "free energy" to create the friction required to roll the sheet material on roll 97 on the main roller 91 limiting the friction required to feed the sheet material by the exit rollers 75, 77, hence providing a more efficient and consistent way to dispense sheet material. Consistent coefficient of friction in the present context does not mean a constant coefficient of friction between the roll of sheet material and main roller. It simply means that as the roll of sheet material is dispensed, the coefficient of friction does not make any radical or extreme changes. Additional embodiments of gravity-assisted roll feed mechanisms are described in U.S. Pat. No. 7,213,782 and U.S. Pat. No. 7,370,824 and are incorporated by reference herein.

With reference to FIG. 8, at least one battery 144 powers the motor 108, the proximity sensor 136, the signal means 128, and the control circuit 104. A rechargeable battery, such as a nickel metal hydride (NiMH) battery, can be used and sized for the power demand of the sheet material dispenser's electronics. A component within the control circuit 104 measures battery voltage periodically. In some embodiments, the control circuit 104 activates a low battery light visible on the outside of the housing when the battery reaches a predetermined low voltage level.

In one embodiment, the amount of sheet material remaining on roll 97 as well as battery life and dispenser open/closed status can be displayed on a liquid crystal display (LCD) on the front panel of the dispenser.

Figure 3B:
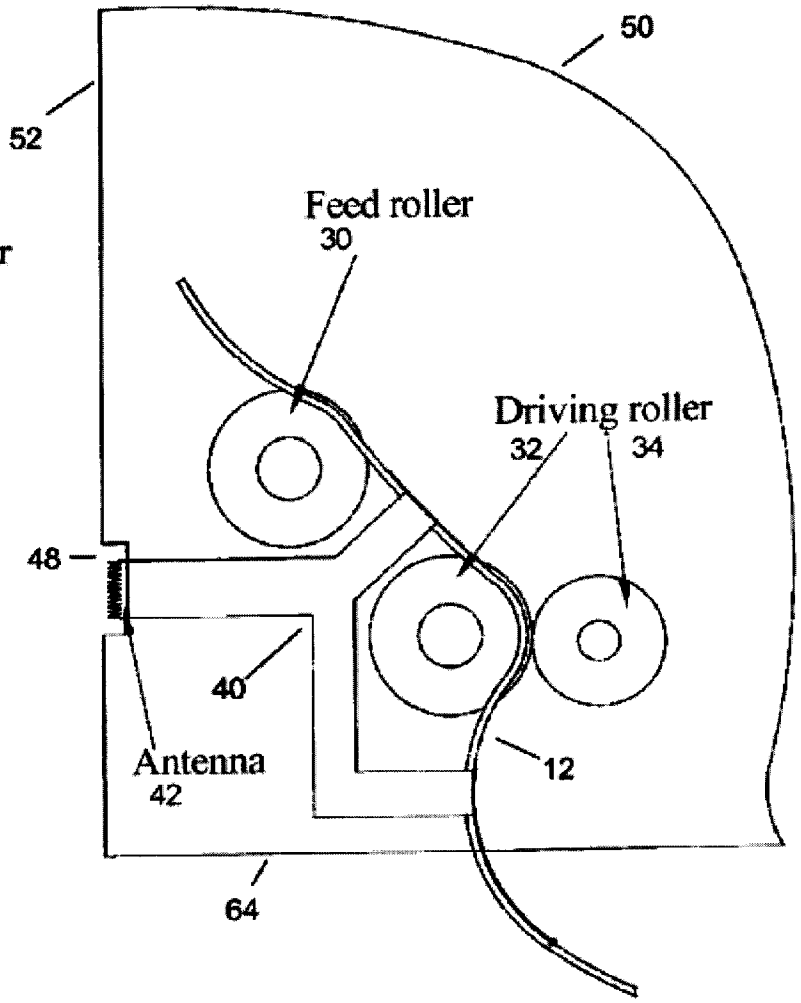
FIG. 3B illustrates a side view of the dispenser of FIG. 3A.
Figure 3A:
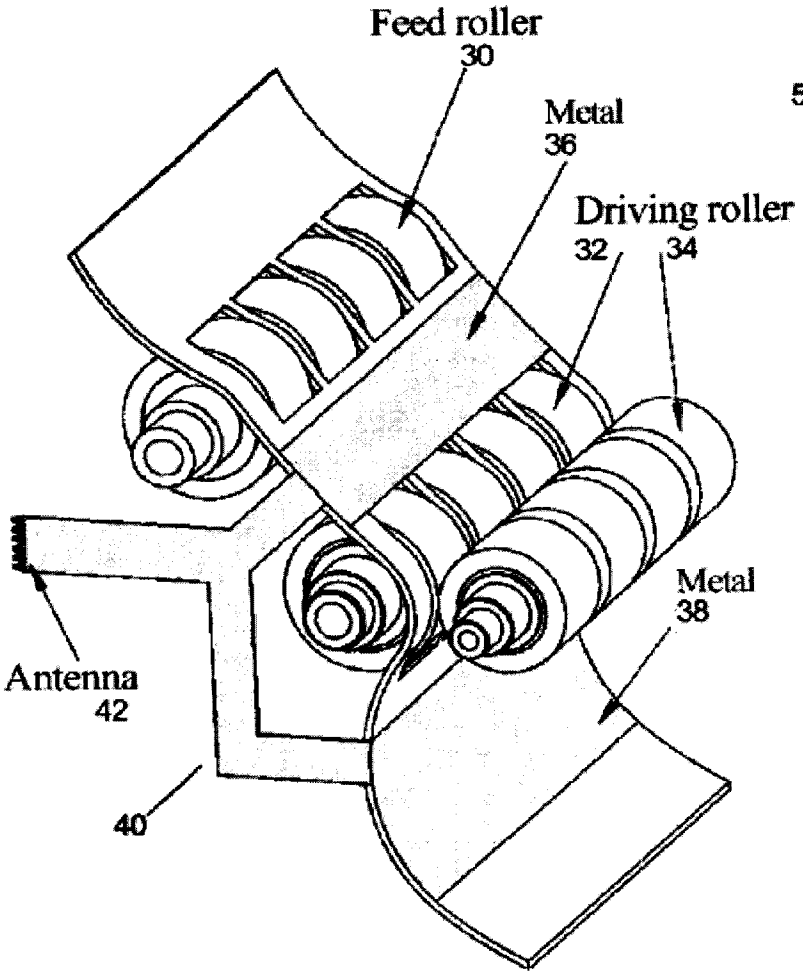
FIG. 3A illustrates a perspective view of an antenna arrangement for dissipating static electricity build-up in a dispensing mechanism for dispensing flexible rolled sheet material.

With reference to FIG. 3A-3B, the dispensing mechanism dispenses a measured length of the sheet material, which may be accomplished by various means, such as a timing circuit that stops the drive rollers 32, 34 after a predetermined time. In one embodiment, a revolution counter is provided that measures the degree of rotation of the drive rollers 32, 34 and is interfaced with control circuitry to stop a drive roller motor after a defined number of revolutions of the rollers 32, 34. This counter may be an optical encoder type of device, or a mechanical device. The control circuitry may include a device to allow maintenance personnel to adjust the sheet length by increasing or decreasing the revolution counter set point.

Static electricity build-up is a common problem in electronic sheet material dispensers that is generated from operation of the dispenser. Various methods for dissipating static charge build-up in electronic sheet material dispensers are within the scope of the invention, and include placing at least one component within the dispenser in electrical conductive communication with an antenna that is disposed relative to the dispenser housing to dissipate static charge to air surrounding the antenna. The antenna could be placed in electrical conductive communication with the component by any conventional low impedance means. For example, the component may be connected to the antenna through a wire, foil, or other conductive path. Any manner of conventional electrical connection may be used to interconnect the antenna, conductive members, and component.

The dispenser component may be any one or combination of elements that are susceptible to generating or accumulating static charge. For example, the component may be the shaft or surface of the drive roller or pressure roller. The component may be the tear bar against which the sheet material is pulled in order to separate a sheet of the material. In some embodiments, the component may be the sheet material itself. The antenna could be in conductive communication with the sheet material along any portion of the conveying path of the sheet material through the internal volume of the dispenser. A collection plate, such as a foil plate or strip, may be disposed along the conveying path of the sheet material at a location that ensures that the sheet material slides along the plate, such as where the sheet material changes direction. This collection plate is in conductive communication with the antenna to dissipate static charge from the sheet material.

In an alternate embodiment, the antenna could be in conductive communication with one or more internal components of the dispenser through an intermediate device. For example, the antenna and internal components may be wired to a common collection point or node. In another embodiment, the component may be wired to a ground terminal within the dispenser's control circuitry, with the antenna wired to the same terminal. Additional embodiments of static charge dissipating mechanisms for electronic dispensers are described in US 2008/0100982 and are incorporated by reference herein.

The antenna can include either a single point or a multipoint array. The antenna discharges static electricity to the air in the space surrounding the antenna. In some embodiments, the antenna can be connected to the tear bar. The antenna may be made from any material suitable for electrostatic conduction and ionization of air. For example, the antenna may constitute an exposed wire, strip of sheet metal, foil, etc. The dissipation system is not limited by the type or configuration of the antenna or materials. The antenna is desirably electrically isolated from other components of the dispenser and disposed so as to dissipate the static charge through a non-conductive material external to the dispenser housing. In one embodiment, the antenna can be located within the dispenser such that it is open to external air allowing the static charge to be dissipated through the air by corona discharge. This location may be defined by a component of the housing, for example, within an external wall of the dispenser housing. In one embodiment, the antenna can be disposed in the back wall of the dispenser housing. In this manner, the antenna is hidden from view and generally protected. A cover may be disposed over the recess to prevent access or inadvertent touching of the antenna by maintenance personnel. The cover could be perforated or otherwise contain passages for the free flow of air into the compartment.

Although not intended to be limited to any particular operational principle, it is believed that the antenna collects the relatively high static charge voltage of the dispenser components to ionize air molecules and induce a corona discharge in the air surrounding the individual antenna's sharp points. Since the ions are subjected to the electric field concentrated at the antenna points, ions of a polarity opposite to the static charge polarity will travel along the electric field lines to the antenna, thereby neutralizing the field. The oppositely charged ions are neutralized as they move beyond the ionization region. This process continues until the field has been reduced to the point where ionization of air ceases. This corona discharge principle is thus a function of the antenna's ability to induce ionization using the static charge received from the components in conductive communication with the antenna. The electrical energy generated during this process is small and insufficient to create a spark.

Aspects of the static charge dissipation system and method are described with reference to FIG. 3A-3B. The antenna 42 is located relative to the dispenser so as to be exposed to the exterior of the dispenser. In one embodiment, an antenna 42 could be located in a rear section 52 of the housing. The antenna 42 is connected to a conductive element 40 within the dispensing mechanism 100. The antenna 42 receives static charge generated by operation of the dispenser 100, the antenna 42 being electrically isolated and disposed so as to dissipate the static charge via a corona discharge to a non-conductive material external to the housing 100.

The antenna 42 is disposed in electrical conductive communication with at least one internal component 36, 38 of the dispenser 100 that is susceptible to generation and accumulation of static charge upon operation of the dispenser. In one embodiment, the antenna 42 is disposed within a recess 48 defined in the back wall 52 of the dispenser housing. The recess 48 in the back wall 52 of the housing hides and isolates the antenna 42 from users, and is only accessible upon removing the cover 50 from the supporting wall structure. It may be desirable to include a cover member (not shown) over the recess 48 to further isolate and protect the antenna 42. The cover member could be perforated or otherwise includes air passages therethrough so that the interior volume of the recess 48 is exposed to free airflow.

It should be appreciated that the antenna 42 need not necessarily be disposed within a recess 48, and may be disposed at any location relative to the dispenser 100 so as to be exposed externally. For example, the antenna 42 could be disposed at the top of the dispenser 100, or below the dispenser 100 along the underside 64.

The configuration and type of antenna 42 may vary. In the embodiment illustrated in FIG. 3A-3B, the antenna 42 is defined by a multiple point array configuration, such as a branched configuration of multiple antenna arms. A multiple point antenna may be formed in various ways. For example, a strip of sheet metal may be bent into any desired antenna shape and have a plurality of individual "teeth" or similar features 42*a*, defined along the edge thereof, with each tooth constituting an antenna point. In another embodiment, a plurality of individual antenna points, such as copper barbs, may be welded or otherwise attached to a conductive metal base, such as a strip of sheet metal.

Any manner or combination of components within the dispenser 100 may be in electrical conductive communication with the antenna 42 for dissipating static charge. In the embodiment shown in FIG. 3, the drive rollers 32, 34 are in conductive contact with metal plates 36, 38, respectively. The metal plates are connected to the antenna 42 within the recess 48 via metal structure 40. The shafts of either or both of the rollers may also be in communication with the antenna 42. The conductive paths established by the conductors 36, 38 may be defined at any convenient location within the interior volume of the dispenser 100.

In another embodiment, the tear bar 20 could be in conductive communication with the antenna 42. The tear bar 20 may be rigidly or movably mounted and, thus, the conductive path is appropriately configured to mate with the tear bar 20. For a rigid tear bar 20, the conductive path may be any suitable stationary electrical connection.

The corresponding structures, materials, acts, and equivalents of all means plus function elements in any claims below are intended to include any structure, material, or acts for performing the function in combination with other claim elements as specifically claimed. Those skilled in the art will appreciate that many modifications to the exemplary embodiments are possible without departing from the scope of the present invention.

In addition, it is possible to use some of the features of the embodiments disclosed without the corresponding use of the other features. Accordingly, the foregoing description of the exemplary embodiments is provided for the purpose of illustrating the principles of the invention, and not in limitation thereof, since the scope of the present invention is defined solely by the appended claims.

What is claimed:

1. A dispenser for flexible rolled sheet material, comprising:

a housing containing a support mechanism for holding at least one roll of flexible sheet material, said housing comprising a base for mounting to a surface, a cover pivotally mounted to the base, and a discharge chute formed within the housing for discharging the sheet material from the dispenser;

a control circuit to control dispensing of the sheet material from the housing;

a dispensing mechanism to drive the sheet material from the housing along a discharge path though the discharge chute upon receiving a signal from the control circuit;

a proximity sensor having an adjustable detection range, wherein the proximity sensor is mounted in a bottom section of the housing forward of the discharge chute facing downward and rearward toward an outermost edge of the discharge chute, and wherein the dispensing mechanism is operative in a first mode to be responsive to a signal from the proximity sensor to dispense a length of the sheet material;

a substantially stationary tear bar mounted within the housing for severance of the sheet material by a user;

a pivotally mounted pawl member located proximate said tear bar such that movement of the sheet material into the tear bar for severance pivots the pawl member from a first position to a second position;

a signal means cooperative with the pawl member and located such that movement of the pawl member to the second position causes the signal means to send a signal to notify the control circuit that the sheet material has been removed; and a paper detection sensor located along the discharge path in a position to detect the presence or absence of the sheet material in the discharge chute for verifying removal of a dispensed length of the sheet material from the dispenser, wherein the dispensing mechanism is operative in a second mode to dispense a next length of the sheet material in response to the signal means being activated by movement of the pawl member to the second position and/or in response to a signal from the paper detection sensor verifying that the dispensed length of the sheet material has been removed from the dispenser.

2. The dispenser of claim 1 wherein the signal means cooperative with the pawl member comprises a magnetic switch.

3. The dispenser of claim 1 wherein the pawl member is electrically conductive and electrically connected to the control circuit forming a part of an electric circuit.

4. The dispenser of claim 1 wherein the signal means cooperative with the pawl member comprises an infrared emitter and detector positioned opposite one another such that pivoting of the pawl member to the second position blocks reception of emitted light by the detector thereby sending a signal to the control circuit.

5. The dispenser of claim 1 wherein the signal means cooperative with the pawl member comprises an infrared emitter/detector pair mounted in the housing such that movement of the pawl member to the second position reflects emitted light back to the detector thereby sending a signal to the control circuit.

6. The dispenser of claim 1 further comprising a multi-position switch in operable communication with the control circuit to select one of a plurality of sheet lengths to be dispensed by the dispensing mechanism.

7. The dispenser of claim 6 further comprising an encoder in operable communication with the control circuit to control a length of delivered sheet material based on a setting of the multi-position switch.

8. The dispenser of claim 7 wherein the dispensing mechanism comprises a drive roller, and wherein the encoder comprises a plurality of magnetic strips integrally incorporated within or affixed around the periphery on an end of the drive roller, and a magnetic switch mounted in the housing in proximity to the end the drive roller such that magnetic strips passing the magnetic switch generate a series of pulses that the control circuit counts to determine when a selected amount of the sheet material has been dispensed.

9. The dispenser of claim 7 wherein the dispensing mechanism comprises a drive roller, and wherein the encoder comprises a fan or star shaped reflective surface integrally incorporated within or affixed on an end of the drive roller and an infrared emitter/detector pair mounted in the housing in proximity to the end of the drive roller such that the leading and trailing edges of the reflective surface reflects emitted light back to the detector generating pulses countable by the control circuit to determine when a selected amount of the sheet material has been dispensed.

10. The dispenser of claim 7 wherein the dispensing mechanism includes a drive roller, and wherein the encoder comprises a plurality of reflective strips integral to or affixed around the periphery on an end of the drive roller and an infrared emitter/detector pair mounted in the housing in proximity to the end of the drive roller such that the reflective strips passing the infrared emitter/detector pair receive light from the emitter and reflect light back to the detector generating a series of pulses that the control circuit counts to determine when a selected amount of the sheet material has been dispensed.

11. The dispenser of claim 1, wherein the paper detection sensor comprises at least one infrared emitter and at least one infrared detector, wherein the infrared emitter is aligned to detect the presence of the sheet material along the outermost edge of the discharge chute.

12. The dispenser of claim 1 wherein the support mechanism for the at least one roll is pivotally mounted within the housing.

13. The dispenser of claim 1 further comprising a multi-position switch in operable communication with the control circuit to select a power output level delivered to the proximity sensor.

14. The dispenser of claim 1 further comprising a multi-position switch in operable communication with the control circuit to select one of a plurality of time periods as a delay between delivery of a first sheet and delivery of a next sheet to the user.

15. The dispenser of claim 1 further comprising an antenna located in a rear section of the housing, said antenna being connected to a conductive element within the dispensing mechanism, said antenna receiving static charge generated by operation of said dispenser, said antenna being electrically isolated and disposed so as to dissipate the static charge via a corona discharge to a non-conductive material external to said housing.

16. The dispenser of claim 15 wherein the antenna discharges static electricity to a space surrounding the antenna.

17. A dispenser for flexible rolled sheet material, comprising:

a housing containing a support mechanism to hold at least one roll of flexible sheet material, said housing comprising a base for mounting to a surface, a cover pivotally mounted to the base, and a discharge chute formed within the housing for discharging the sheet material to an area outside the housing;

a control circuit to control dispensing of the sheet material from the housing;

a dispensing mechanism to drive the sheet material along a path extending through the discharge chute of the housing upon receiving a signal from the control circuit;

a proximity sensor having an adjustable detection range, wherein the dispensing mechanism is operative in a first mode to be responsive to a signal from the proximity sensor to dispense a sheet of the sheet material;

a substantially stationary tear bar mounted within the housing for severance of the sheet from the sheet material by a user;

a pivotally mounted pawl member located proximate said tear bar such that movement of the sheet material into the tear bar for severance pivots the pawl member from a first position to a second position;

a signal means cooperative with the pawl member and located such that movement of the pawl member to the second position causes the signal means to send a signal to notify the control circuit that the sheet has been removed; and a paper detection sensor focused across at least a portion of the path extending through the discharge chute, wherein the paper detection sensor is activated by the control circuit to verify that the sheet has been removed from the discharge chute, and wherein the paper detection sensor comprises an emitter and a detector, wherein the emitter is mounted adjacent to an end portion of the discharge chute and positioned to emit a signal through an opening in a bottom panel of the housing toward the detector mounted within the housing, and wherein the dispensing mechanism is operative in a second mode to dispense a next sheet of the sheet material in response to a signal from the paper detection sensor verifying that the sheet has been removed from the dispenser.

18. The dispenser of claim 17 wherein the signal means cooperative with the pawl member comprises a magnetic switch.

19. The dispenser of claim 17 wherein the pawl member is electrically conductive and electrically connected to the control circuit forming a part of an electric circuit.

20. The dispenser of claim 17 wherein the signal means cooperative with the pawl member comprises an infrared emitter and detector positioned opposite one another such that pivoting of the pawl member to the second position blocks reception of emitted light by the detector thereby sending a signal to the control circuit.

21. The dispenser of claim 17 wherein the signal means cooperative with the pawl member comprises an infrared emitter/detector pair mounted in the housing such that movement of the pawl member to the second position reflects emitted light back to the detector thereby sending a signal to the control circuit.

22. The dispenser of claim 17 further comprising a multi-position switch in operable communication with the control circuit to select one of a plurality of sheet lengths to be dispensed by the dispensing mechanism.

23. The dispenser of claim 22 further comprising an encoder in operable communication with the control circuit to control a length of delivered sheet material based on a setting of the multi-position switch.

24. The dispenser of claim 23 wherein the dispensing mechanism comprises a drive roller, and wherein the encoder comprises a plurality of magnetic strips integrally incorporated within or affixed around the periphery on an end of the drive roller, and a magnetic switch mounted in the housing in proximity to the end of the drive roller such that magnetic strips passing the magnetic switch generate a series of pulses that the control circuit counts to determine when a selected amount of the sheet material has been dispensed.

25. The dispenser of claim 23 wherein the dispensing mechanism comprises a drive roller, and wherein the encoder comprises a fan or star shaped reflective surface integrally incorporated within or affixed on an end of the drive roller and an infrared emitter/detector pair mounted in the housing in proximity to the end of the drive roller such that the leading and trailing edges of the reflective surface reflects emitted light back to the detector generating pulses countable by the control circuit to determine when a selected amount of the sheet material has been dispensed.

26. The dispenser of claim 23 wherein the dispensing mechanism comprises a drive roller, and wherein the encoder comprises a plurality of reflective strips integral to or affixed around the periphery on an end of the drive roller and an infrared emitter/detector pair mounted in the housing in proximity to the end of the drive roller such that the reflective strips passing the infrared emitter/detector pair receive light from the emitter and reflect light back to the detector thereby generating a series of pulses that the control circuit counts to determine when a selected amount of the sheet material has been dispensed.

27. The dispenser of claim 17 wherein the support mechanism for the at least one roll is pivotally mounted within the housing.

28. The dispenser of claim 17 further comprising a multi-position switch in operable communication with the control circuit to select a power output level delivered to the proximity sensor.

29. The dispenser of claim 17 further comprising a multi-position switch in operable communication with the control circuit to select one of a plurality of time periods as a delay between delivery of a first sheet and delivery of a next sheet to the user.

30. The dispenser of claim 17 further comprising an antenna located in a rear section of the housing, said antenna being connected to a conductive element within the dispensing mechanism, said antenna receiving static charge generated by operation of said dispenser, said antenna being electrically isolated and disposed so as to dissipate the static charge via a corona discharge to a non-conductive material external to said housing.

31. The dispenser of claim 30 wherein the antenna discharges static electricity to a space surrounding the antenna.

32. A dispenser for flexible rolled sheet material, comprising:

a housing containing a support mechanism to hold at least one roll of flexible sheet material, said housing comprising a base for mounting to a surface, a cover pivotally mounted to the base, and a discharge chute formed within the housing for discharging the sheet material to an area outside the housing;

a control circuit to control dispensing of the sheet material from the housing;

a dispensing mechanism to drive the sheet material along a path extending through the discharge chute of the housing upon receiving a signal from the control circuit;

a proximity sensor having an adjustable detection range, wherein the proximity sensor is mounted in a bottom section of the housing forward of the discharge chute facing downward and rearward toward an outermost edge of the discharge chute, and wherein the dispensing mechanism is operative in a first mode to be responsive to a signal from the proximity sensor to dispense a sheet of the sheet material;

a substantially stationary tear bar mounted within the housing for severance of the sheet from the sheet material by a user;

a pivotally mounted pawl member located proximate said tear bar such that movement of the sheet material into the tear bar for severance pivots the pawl member from a first position to a second position;

a signal means cooperative with the pawl member and located such that movement of the pawl member to the second position causes the signal means to send a signal to notify the control circuit that the sheet has been removed; and a paper detection sensor focused across at least a portion of the path extending through the discharge chute, wherein the paper detection sensor is activated by the control circuit to verify that the sheet has been removed from the discharge chute, and wherein the dispensing mechanism is operative in a second mode to dispense a next sheet of the sheet material in response to a signal from the paper detection sensor verifying that the sheet has been removed from the dispenser.

33. The dispenser of claim 32, wherein the paper detection sensor comprises at least one infrared emitter and at least one infrared detector, wherein the infrared emitter is aligned to detect the presence of an object along the outermost edge of the discharge chute.

* * * * *